US011359501B2

(12) United States Patent
Veluru et al.

(10) Patent No.: US 11,359,501 B2
(45) Date of Patent: Jun. 14, 2022

(54) LOCKING SPACER ASSEMBLY, CORRESPONDING BLADE ASSEMBLY, METHOD FOR INSTALLING A LOCKING SPACER

(71) Applicant: Siemens Energy Global GmbH & Co. KG, Munich (DE)

(72) Inventors: Krishna Veluru, Jupiter, FL (US); Kenneth W. Giersdorf, Port Saint Lucie, FL (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/982,902

(22) PCT Filed: Mar. 28, 2018

(86) PCT No.: PCT/US2018/024765
§ 371 (c)(1),
(2) Date: Sep. 21, 2020

(87) PCT Pub. No.: WO2019/190494
PCT Pub. Date: Oct. 3, 2019

(65) Prior Publication Data

US 2021/0003021 A1 Jan. 7, 2021

(51) Int. Cl.
*F01D 5/32* (2006.01)
*F01D 5/30* (2006.01)

(52) U.S. Cl.
CPC ..... *F01D 5/32* (2013.01); *F01D 5/3038* (2013.01); *F05D 2220/32* (2013.01);
(Continued)

(58) Field of Classification Search
CPC ..... F01D 5/32; F01D 5/3038; F01D 5/326; F05D 2220/32; F05D 2230/644;
(Continued)

(56) References Cited

U.S. PATENT DOCUMENTS

2002/0127105 A1 9/2002 Bachofner et al.
2006/0222502 A1* 10/2006 Hansen ..... F01D 5/3038 416/220 R (Continued)

FOREIGN PATENT DOCUMENTS

CN 104675448 A 6/2015

OTHER PUBLICATIONS

PCT International Search Report and Written Opinion of International Searching Authority dated Jan. 2, 2019 corresponding to PCT International Application No. PCT/US2018/024765 filed Mar. 28, 2018.

*Primary Examiner* — Justin D Seabe
*Assistant Examiner* — Eric A Lange

(57) ABSTRACT

A locking spacer assembly for filling a final spacer slot in a disk groove between platforms of adjacent blades of a blade assembly, a blade assembly and a method for installing a locking spacer assembly into a final spacer slot in a disk groove between platforms of adjacent blades of a blade assembly are presented. The locking spacer assembly includes a first side piece, a second side piece, a bolt and a mid piece. The mid piece includes a hollow cylindrical body to receive the bolt and a top platform to flush with top surfaces of the first and second side pieces and a middle platform disposed at bottom of the hollow cylindrical body. At least two pins are radially inserted through apertures of the first and second side pieces respectively extending toward the middle platform of the mid piece to prevent radial movement of the mid piece.

16 Claims, 4 Drawing Sheets

(52) U.S. Cl.
CPC .... *F05D 2230/644* (2013.01); *F05D 2250/11* (2013.01); *F05D 2250/281* (2013.01); *F05D 2260/31* (2013.01); *F05D 2260/36* (2013.01)

(58) Field of Classification Search
CPC ..... F05D 2250/11; F05D 2250/281; F05D 2260/31; F05D 2260/36; F05D 2230/64; F05D 2250/23
USPC ..... 416/220 R
See application file for complete search history.

(56) References Cited

U.S. PATENT DOCUMENTS

| | | | | |
|---|---|---|---|---|
| 2009/0016889 | A1* | 1/2009 | Krutzfeldt | F01D 5/32 416/204 R |
| 2015/0101347 | A1 | 4/2015 | Potter et al. | |
| 2015/0101348 | A1* | 4/2015 | Hansen | F01D 5/303 60/805 |
| 2015/0101349 | A1 | 4/2015 | Hansen et al. | |
| 2015/0101350 | A1 | 4/2015 | Healy et al. | |

* cited by examiner

LOCKING SPACER ASSEMBLY, CORRESPONDING BLADE ASSEMBLY, METHOD FOR INSTALLING A LOCKING SPACER

TECHNICAL FIELD

This invention relates generally to a locking spacer assembly, in particular, a locking spacer assembly configured to fill a final spacer slot in a disk groove between platforms of adjacent blades of a blade assembly in an industrial gas turbine engine.

DESCRIPTION OF RELATED ART

An industrial gas turbine engine typically includes a compressor for compressing air, a combustor for mixing the compressed air with fuel and igniting the mixture, a turbine section for producing mechanical power, and a generator for converting the mechanical power to an electrical power. The compressor and the turbine section include a plurality of blades that are attached on a rotor. The blades are arranged in rows axially spaced apart along the rotor and circumferentially attached to a periphery of a rotor disk.

FIG. 1 illustrates a schematic perspective view of a portion of a blade assembly 100. As illustrated in FIG. 1, the blade assembly 100 includes a plurality of blades 120 that are attached to a rotor disk 140. Each blade 120 includes a platform 122 and a root 124 extending radially inward from the platform 122. During blade assembly, the blades 120 may be installed to the rotor disk 140 by inserting the roots 124 of the blades 120 into a disk groove 142 one at a time. The blades 120 then may be rotated until the roots 124 of the blade 120 engage the disk groove 142. Once all of the blades 120 are installed into the rotor disk 140, a final spacer slot 144 is remained in the disk groove 142 between the platforms 122 of adjacent blades 120. The final spacer slot 144 may not be filled with the blade 120 because there is not sufficient space for insertion and rotation. A locking spacer assembly is typically inserted into the final spacer slot 144 to lock the blades 120 to the rotor disk 140.

A conventional locking spacer assembly typically includes a plurality of pieces, such as side pieces, middle piece, bolt and nut. The conventional locking spacer assembly may experience uncertainties during assembly. For example, positive clamping may be needed to reduce dynamic loads transferred to the bolted joint. However, maintaining positive clamping may result in higher bearing stresses and limits available operating temperature range for joint material. Additionally, manufacture cost of the conventional locking spacer assembly may be high. There is a need to provide a simple, reliable and low cost locking spacer assembly.

SUMMARY OF INVENTION

Briefly described, aspects of the present invention relate to a locking spacer assembly, in particular, a locking spacer assembly configured to fill a final spacer slot in a disk groove between platforms of adjacent blades of a blade assembly in an industrial gas turbine engine.

According to an aspect, a locking spacer assembly configured to fill a final spacer slot in a disk groove between platforms of adjacent blades of a blade assembly is presented. The locking spacer assembly comprises a first side piece comprising a top surface, an inner surface and an outer surface. The locking spacer assembly comprises a second side piece comprising a top surface, an inner surface and an outer surface. The locking spacer assembly comprises a bolt configured to be inserted between the inner surface of the first side piece and the inner surface of the second side piece. The locking spacer assembly comprises a mid piece configured to be disposed onto the bolt and inserted between the inner surface of the first side piece and the inner surface of the second side piece. The top surface of the first side piece comprises a L-shape formed by a tab and a recess. The top surface of the second side piece comprises a L-shape formed by a tab and a recess. The mid piece comprises a hollow cylindrical body to receive the bolt. The mid piece comprises a top platform disposed around a top of the hollow cylindrical body and a middle platform disposed around a bottom of the hollow cylindrical body. The top platform comprises two L-shaped axial side surfaces adapted to flush with the L-shaped top surface of the first side piece and the L-shaped top surface of the second side piece. The first side piece comprises an aperture disposed through the tab of the first side piece. The second side piece comprises an aperture disposed through the tab of the second side piece. A first pin and a second pin are radially disposed through the aperture of the first side piece and the aperture of the second side piece extending toward to the middle platform of the mid piece.

According to an aspect, a blade assembly is presented. The blade assembly comprises a rotor disk comprising a disk groove. The blade assembly comprises a plurality of blades inserted in the disk groove. Each of the blades comprises a platform. A final spacer slot is formed in the disk groove between platforms of adjacent blades. The blade assembly comprises a locking spacer assembly configured to fill the final spacer slot. The locking spacer assembly comprises a first side piece comprising a top surface, an inner surface and an outer surface. The locking spacer assembly comprises a second side piece comprising a top surface, an inner surface and an outer surface. The locking spacer assembly comprises a bolt configured to be inserted between the inner surface of the first side piece and the inner surface of the second side piece. The locking spacer assembly comprises a mid piece configured to be disposed onto the bolt and inserted between the inner surface of the first side piece and the inner surface of the second side piece. The top surface of the first side piece comprises a L-shape formed by a tab and a recess. The top surface of the second side piece comprises a L-shape formed by a tab and a recess. The mid piece comprises a hollow cylindrical body to receive the bolt. The mid piece comprises a top platform disposed around a top of the hollow cylindrical body and a middle platform disposed around a bottom of the hollow cylindrical body. The top platform comprises two L-shaped axial side surfaces adapted to flush with the L-shaped top surface of the first side piece and the L-shaped top surface of the second side piece. The first side piece comprises an aperture disposed through the tab of the first side piece. The second side piece comprises an aperture disposed through the tab of the second side piece. A first pin and a second pin are radially disposed through the aperture of the first side piece and the aperture of the second side piece extending toward to the middle platform of the mid piece.

According to an aspect, a method for installing a locking spacer assembly into a final spacer slot in a disk groove between platforms of adjacent blades of a blade assembly is presented. The locking spacer assembly comprises a first side piece, a second side piece, a bolt and a mid piece. The method comprises inserting the first side piece and the second side piece into the final spacer slot. The first side piece comprises a top surface, an inner surface and an outer surface. The second side piece comprises a top surface, an inner surface and an outer surface. The method comprises inserting the bolt between the inner surface of the first side piece and the inner surface of the second side piece. The method comprises disposing the mid piece onto the bolt and inserted between the inner surface of the first side piece and the inner surface of the second side piece. The top surface of the first side piece comprises a L-shape formed by a tab and a recess. The top surface of the second side piece comprises a L-shape formed by a tab and a recess. The first side piece comprises an aperture disposed through the tab of the first side piece. The second side piece comprises an aperture disposed through the tab of the second side piece. The mid piece comprises a hollow cylindrical body to receive the bolt. The mid piece comprises a top platform disposed around a top of the hollow cylindrical body and a middle platform disposed around a bottom of the hollow cylindrical body. The top platform of the mid piece comprises two L-shaped axial side surfaces. The method comprises rotating the mid piece such that the L-shaped axial side surfaces align with the L-shaped top surface of the first side piece and the L-shaped top surface of the second side piece respectively. The method comprises dropping down the mid piece such that the L-shaped axial sides flush with the L-shaped top surface of the first side piece and the L-shaped top surface of the second side piece. The method comprises radially disposing a first pin and a second pin through the aperture of the first side piece and the aperture of the second side piece toward to the middle platform of the mid piece.

Various aspects and embodiments of the application as described above and hereinafter may not only be used in the combinations explicitly described, but also in other combinations. Modifications will occur to the skilled person upon reading and understanding of the description.

DETAILED DESCRIPTION OF INVENTION

Exemplary embodiments of the application are explained in further detail with respect to the accompanying drawings. In the drawings.

To facilitate understanding, identical reference numerals have been used, where possible, to designate identical elements that are common to the figures.

DETAILED DESCRIPTION OF INVENTION

A detailed description related to aspects of the present invention is described hereafter with respect to the accompanying figures.

Figure 1:
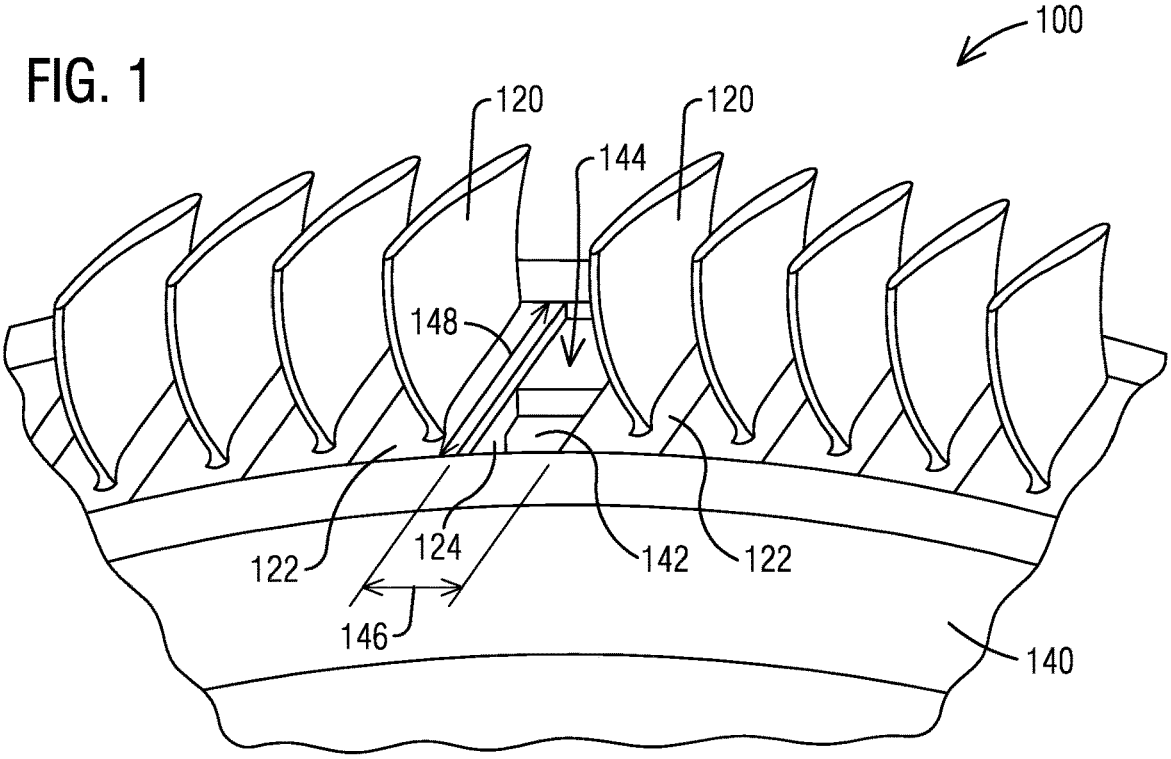
FIG. 1 illustrates a schematic perspective view of a portion of a blade assembly showing a final spacer slot, wherein an embodiment of the inventive locking spacer assembly may be incorporated.

FIG. 1 illustrates a schematic perspective view of a portion of a blade assembly 100 showing a final spacer slot 144 in a disk groove 142 between platforms 122 of adjacent blades 120. The final spacer slot 144 may have a circumferential width 146 and an axial length 148. The blade assembly 100 may be a compressor blade assembly or a turbine blade assembly. The final spacer slot 144 may be filled by inventive embodiments of a locking spacer assembly 200 as shown in FIGS. 2-10, which are described in more detail below. The locking spacer assembly 200 may be installed into the final spacer slot 144 in the disk groove 142 during assembly of the blades 120 to the rotor disk 140. The locking spacer assembly 200 may be removed from the final spacer slot 144 in the disk groove 142 during disassembly of the blades 120 from the rotor disk 140.

Figure 2:
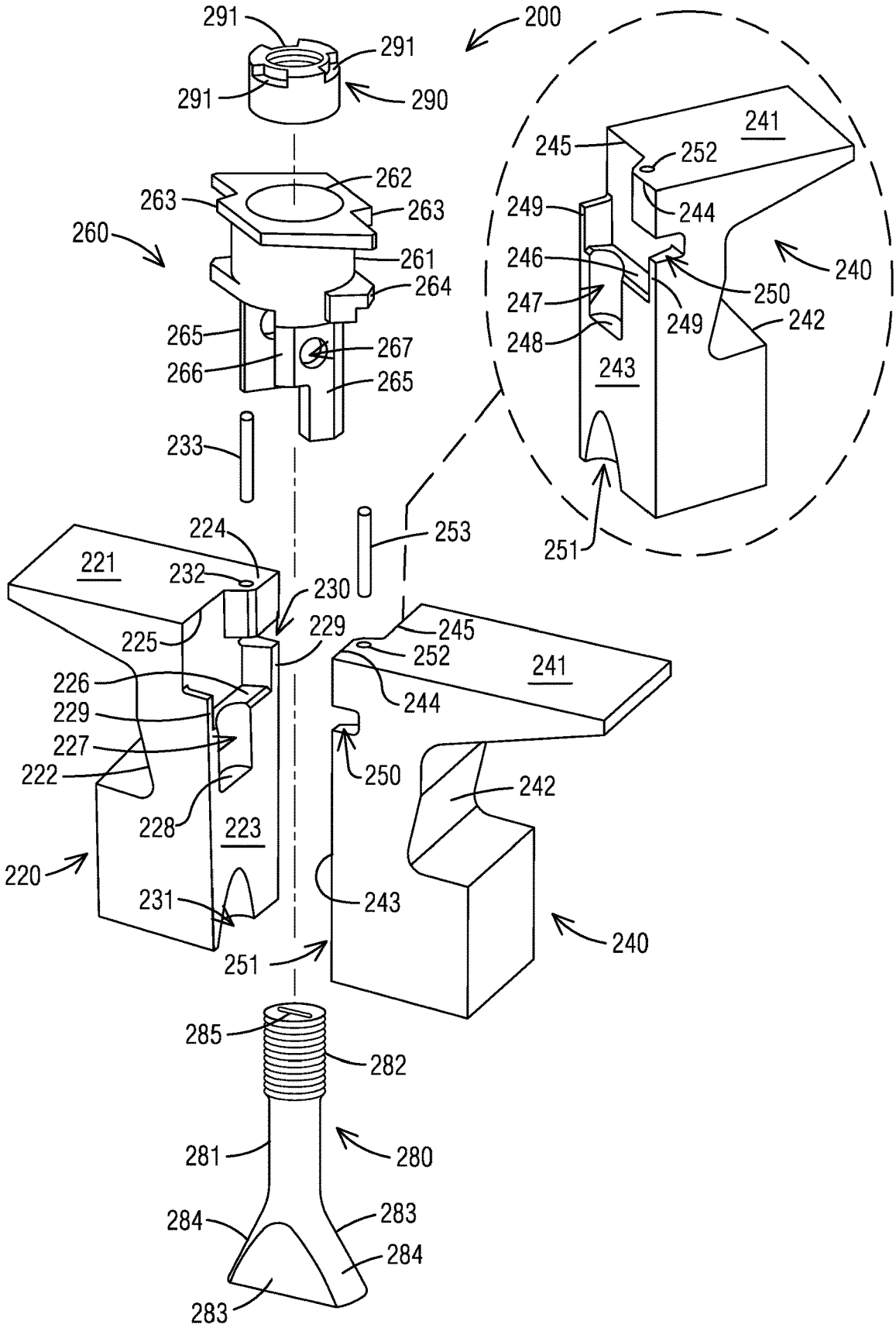
FIG. 2 illustrates a schematic perspective exploded view of a locking spacer assembly according to an embodiment of the invention.

FIG. 2 illustrates a schematic exploded perspective view of a locking spacer assembly 200 according to an embodiment of the invention. With reference to FIG. 2, the locking spacer assembly 200 may include a first side piece 220, a second side piece 240, a mid piece 260, and a bolt 280. The first side piece 220 may include a top surface 221, an outer surface 222, and an inner surface 223. The second side piece 240 may include a top surface 241, an outer surface 242, and an inner surface 243. The bolt 280 may be disposed between the inner surface 223 of the first side piece 220 and the inner surface 243 of the second side piece 240. The mid piece 260 may be disposed onto the bolt 280 from the top. The mid piece 260 may be disposed between the inner surface 223 of the first side piece 220 and the inner surface 243 of the second side piece 240. The outer surface 222 of the first side piece 220 and the outer surface 242 of the second side piece 240 may have a profile that is configured to mate with a profile of a surface 143 of a disk groove 142 such that the outer surface 222 of the first side piece 220 and the outer surface 242 of the second side piece 240 may contact the surface 143 of the disk groove 142 after installed into the disk groove 142, as shown in FIGS. 4-9.

The top surface 221 of the first side piece 220 may have a L-shape formed by a tab 224 and a recess 225. The tab 224 extends axially outwardly from the inner surface 223 at one axial side of the first side piece 220. The recess 225 extends radially downwardly from the top surface 221 on the inner surface 223. A first flange surface 226 extends axially outwardly from the inner surface 223 and locates at the radially downward end of the recess 225. A circular groove 227 extends radially downwardly from the first flange surface 226 on the inner surface 223. A second flange surface 228 is disposed at bottom of the circular groove 227 on the inner surface 223. Two side tabs 229 extends axially outwardly from the inner surface 223 at two axial sides of the first side piece 220, respectively. The two side tabs 229 may extend radially upwardly from the first flange surface 226. The two side tabs 229 may prevent a circumferential movement of the mid piece 260 in assembly. According to an exemplary embodiment as illustrated in FIG. 2, a radial slot 230 may exist between the tab 224 and one side tab 229 at the same side with the tab 224. According to another embodiment, the one side tab 229 at the same side with the tab 224 may extends radially and connect to the tab 224. The tab 224 may have a wider circumferential width than the side tab 229. A concave cavity 231 may be disposed at a bottom of the inner surface 223.

The second side piece 240 may have a mirror configuration with respect to the first side piece 220. For illustration purpose, a different perspective view of the second side piece 240 is also shown in FIG. 2. With reference to FIG. 2, the top surface 241 of the second side piece 240 may have a L-shape formed by a tab 244 and a recess 245. The tab 244 extends axially outwardly from the inner surface 243 at one axial side of the second side piece 240, which is an opposite axial side with respect to the tab 224 of the first side piece 220. The recess 245 extends radially downwardly from the top surface 241 on the inner surface 243. A first flange surface 246 extends axially outwardly from the inner surface 243 and locates at the radially downward end of the recess 245. A circular groove 247 extends radially downwardly from the flange surface 246 on the inner surface 243. A second flange 248 is disposed at bottom of the circular groove 247 on the inner surface 243. Two side tabs 249 extends axially outwardly from the inner surface 243 at two axial sides of the second side piece 240, respectively. The two side tabs 249 may extend radially upwardly from the first flange surface 246. The two side tabs 249 may prevent a circumferential movement of the mid piece 260 in assembly. According to an exemplary embodiment as illustrated in FIG. 2, a radial slot 250 may exist between the tab 244 and one side tab 249 at the same axial side with the tab 244. According to another embodiment, the one side tab 249 at the same side with the tab 244 may extends radially and connect to the tab 244. The tab 244 may have a wider circumferential width than the side tab 249. A concave cavity 251 may be disposed at a bottom of the inner surface 243.

The mid piece 260 may include a hollow cylindrical body 261 extending radially downwardly to receive the bolt 280 in assembly. A top platform 262 may be disposed around the top of the cylindrical body 261 and extends outwardly from outer side of the hollow cylindrical body 261. Two axial side surfaces 263 of the top platform 262 have a mating L-shape that aligns with the L-shaped top surface 221 of the first side piece 220 and the L-shaped top surface 241 of the second side piece 240 respectively. A middle platform 264 may be disposed around the bottom of the hollow cylindrical body 261. The middle platform 264 may rest on the first flange surface 226 of the first side piece 220 and the first flange surface 246 of the second side piece 240 in assembly. The mid piece 260 may include two flaps 265 extending radially downwardly from the bottom of the hollow cylindrical body 261. Bolt 280 may extend through the two flaps 265 and protrude through the hollow cylindrical body 261. Upper portion 266 of each flap 265 may have a circular shape so that it may slide into the circular groove 227 of the first side piece 220 and the circular groove 247 of the second side piece 240 and rotate in the circular groove 227 of the first side piece 220 and the circular groove 247 of the second side piece 240 during assembly. Bottoms of the upper portions 266 of flaps 265 may partially rest on the second flange surface 228 of the first side piece 220 and the second flange surface 248 of the second side piece 240 in assembly such that a distance for disposing the mid-piece 260 onto the bolt 280 is limited. The flaps 265 may include cutout 267 for reducing weight of the mid piece 260. Each flap 265 may have a flat outer surface. Each flap 265 may have a circular upper inner surface and a flat bottom inner surface. The mid piece 260 may be disposed onto the bolt 280 from top of the bolt 280 in assembly so that the bolt 280 extends radially upwardly through the flaps 265 and into the hollow cylindrical body 261.

The bolt 280 may have a shaft body 281. Threads 282 are disposed at upper portion of the shaft body 281. Bottom of the shaft body 281 may have a cam shape having two radially downwardly flat axial surfaces 283 and two convex side surfaces 284. The bolt 280 may be disposed into the mid piece 260 in assembly such that the two convex side surfaces 284 may axially extend out from the two flaps 265 of the mid piece 260 and is disposed into the concave cavity 231 of the first side piece 220 and the concave cavity 251 of the second side piece 240 respectively. The upper circular portion of the inner surfaces of the flaps 265 of the mid piece 260 receive the shaft body 281. The bottom flat portion of the inner surfaces of the flaps 265 of the mid piece 260 may align with the two flat axial surfaces 283 of the cam shaped bottom portion of the bolt 280 respectively. The bolt 280 extends through the two flaps 265 and protrude through the hollow cylindrical body 261 of the mid piece 260. A recess 285 may be disposed on the top surface of the shaft body 281. The recess 285 may be engaged with a tool (not shown) for rotating the bolt 280 during assembly.

The locking spacer assembly 200 may include a fastener 290. The fastener 290 may be a nut having threads inside. The fastener 290 may be disposed into the hollow cylindrical body 261 of the mid piece 260 and threaded with the threads 282 of the bolt 280 during assembly so that the first side piece 220, the second side piece 240, the mid piece 260 and the bolt 280 are locked in position in the disk groove 142 of the rotor disk 140 in assembly. The fastener 290 may have recesses 291 to be engaged with a tool (not shown) for threading the fastener 290 to the bolt 280.

An aperture 232 may be disposed on the top surface 221 of the first side piece 220. The aperture 232 may be drilled radially through the tab 224 of the first side piece 220. Mirror likely, an aperture 252 may be disposed on the top surface 241 of the second side piece 240. The aperture 252 may be drilled radially through the tab 244 of the second side piece 240. During assembly, a first pin 233 and a second pin 253 may be radially inserted through the aperture 232 of the first side piece 220 and the aperture 253 of the second side piece 240. The pins 233 and 253 radially extend toward the middle platform 264 of the mid piece 260 in assembly to avoid a radial movement of the mid piece 260. Such arrangement may maintain the mid piece 260 within the assembly in an event of failure in threads between the bolt 290 and the fastener 290 due to continuous operation so that the mid piece 260 is fail safe without liberating into a flow path during operation. The apertures 232 and 252 may be small holes. The apertures 232 and 252 may have threads inside. The pins 233 and 253 may have threads outside to be engaged with threaded apertures 232 and 252 respectively.

Figure 3:
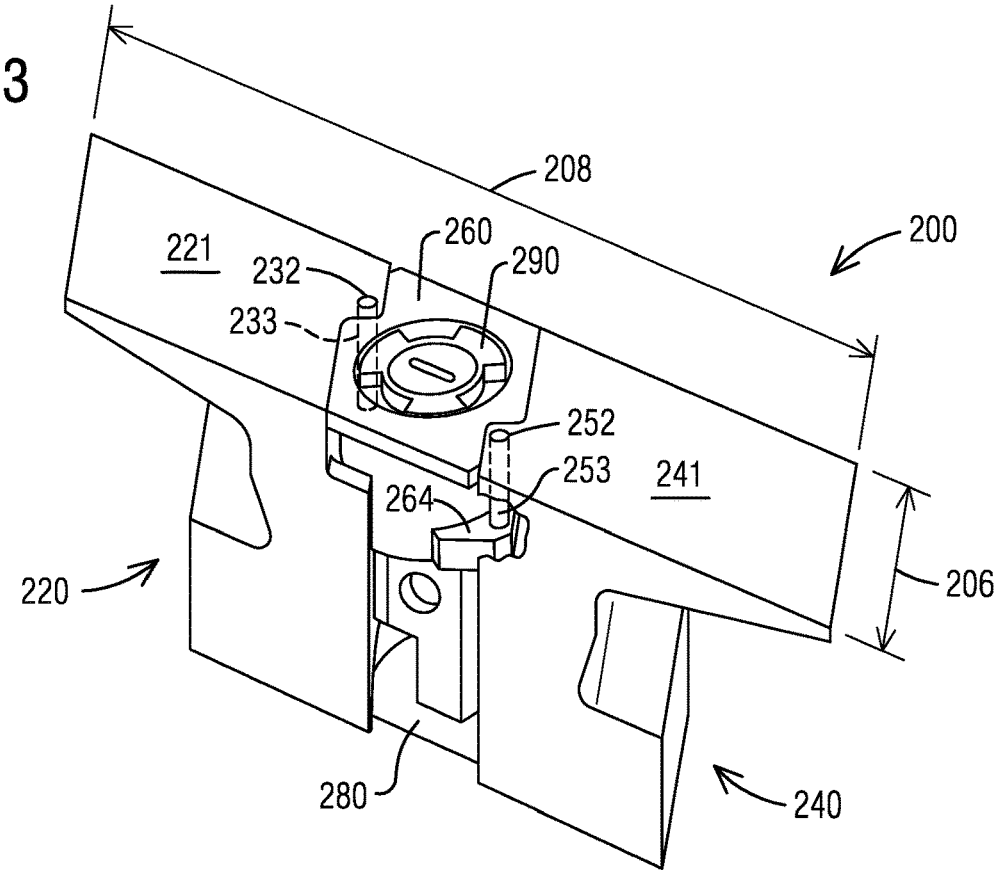
FIG. 3 illustrates a schematic perspective assembled perspective view of a locking spacer assembly according to an embodiment of the invention.

FIG. 3 illustrates a schematic assembled perspective view of the locking spacer assembly 200 as shown in FIG. 2. With reference to FIG. 3, the mid piece 260 is disposed between the first side piece 220 and the second side piece 240 after assembly. Two L-shaped axial side surfaces 263 of the top platform 262 of the mid piece 260 flush with the L-shaped top surface 221 of the first side piece 220 and the L-shaped top surface 241 of the second side piece 240 respectively. The mid piece 260 is disposed onto the bolt 280 from top. The convex side surfaces 284 of the cam shaped bottom portion of the bolt 280 axially extends out from the two flaps 265 of the mid piece 260 and insert into the concave cavity 231 of the first side piece and the concave cavity 251 of the second piece 240 respectively. Bottom portion of the flaps 265 of the mid piece 260 may align with the two flat axial surfaces 283 of the cam shaped bottom portion of the bolt 280. The fastener 290 is disposed into the mid piece 260 from the top and threaded with the bolt 280. The first pin 233 and the second pin 253 are inserted through the aperture 232 of the first side piece 220 and the aperture 252 of the second side piece 240 respectively toward to the middle platform 264 of the mid piece 260 to prevent a radial movement of the mid piece 260. The locking spacer assembly 200 has a circumferential width 206 and an axial length 208 after assembly. The circumferential width 206 and the axial length 208 correspond to a circumferential width 146 and an axial length 148 of a final spacer slot 144 in a disk groove 142, as shown in FIG. 1.

Figure 4:
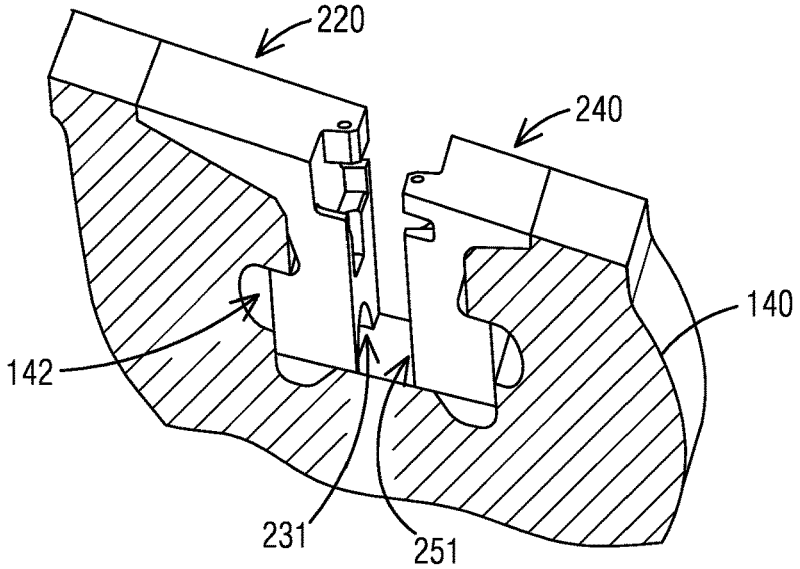
FIGS. 4-9 illustrate schematic sequential assembly perspective views of a locking spacer assembly according to an embodiment of the invention.

FIGS. 4-9 illustrate schematic sequential assembly cross section perspective views of a locking spacer assembly 200 according to an embodiment of the invention. With reference to FIG. 4, according to an embodiment, the first side piece 220 and the second side piece 240 may be placed into the final spacer slot 144 in the disk groove 142 of the rotor disk 140 one after another. For example, the first side piece 220 may be firstly placed into the final spacer slot 144 in the disk groove 142 and then axially moved to a side of the disk groove 142 such that the outer surface 222 of the first side piece 220 is in contact with the surface 143 of the disk groove 142. The second side piece 240 may be secondly placed into the final spacer slot 144 in the disk groove 142 and then axially moved to another side of the disk groove 142 such that the outer surface 242 is in contact with the surface 143 of the disk groove 142. According to another embodiment, the first side piece 220 and the second side piece 240 may also be placed next to each other by the tab 224 of the first side piece 220 extending into the recess 245 of the second side piece 240 and the tab 244 of the second side piece 240 extending into the recess 225 of the first side piece 220 and may then be placed into the final spacer slot 144 in the disk groove 142 of the rotor disk 140 together and axially moved to two sides of the disk groove 142 such that the outer surface 222 of the first side piece 220 and the outer surface 242 of the second side piece 240 may be in contact with the surface 143 of the disk groove 142.

Figure 5:
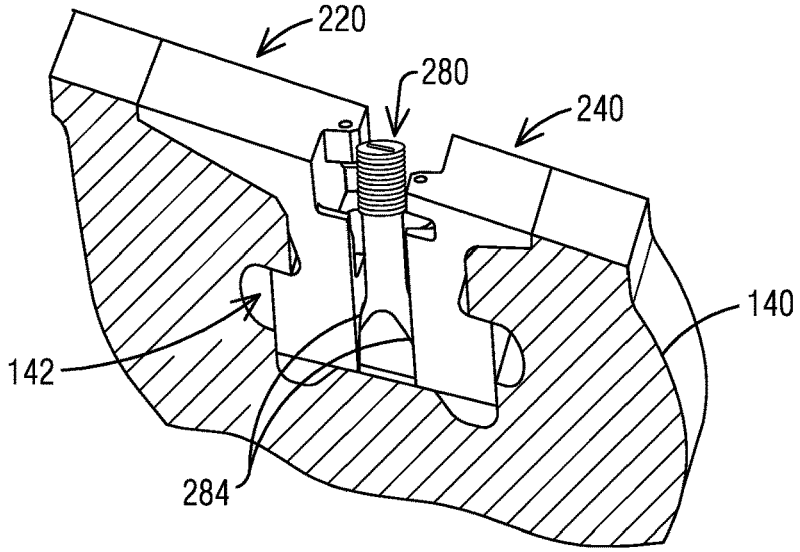

With reference to FIG. 5, the bolt 280 is inserted between the first side piece 220 and the second side piece 240. The bolt 280 is then rotated such that the convex side surfaces 284 are disposed into the concave cavity 231 of the first side piece 220 and the concave cavity 251 of the second side piece 240.

Figure 6:
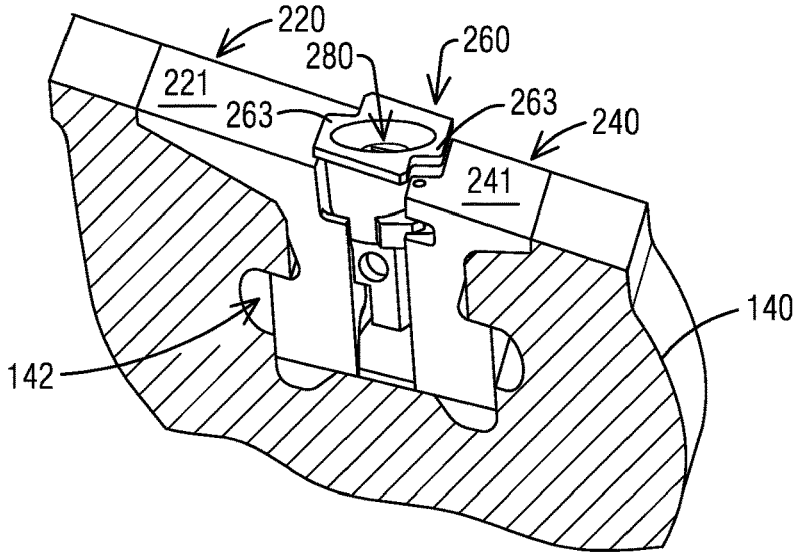

With reference to FIG. 6, the mid piece 260 may then be inserted between the first side piece 220 and the second side piece 240 and disposed onto the bolt 280 from top of the bolt 280 so that the bolt 280 extends into the hollow cylindrical body 261. The upper portions 266 of the flaps 265 of the mid piece 260 firstly slide into the circular groove 227 of the first side piece 220 and the circular grove 247 of the second side piece 240 respectively. Bottoms of the upper portions 266 may partially rest on the second flange 228 of the first side piece 220 and the second flange 248 of the second side piece 240 such that a distance for disposing the mid-piece 260 onto the bolt 280 is limited. The mid piece 260 is then rotated such that the two L-shaped axial side surfaces 263 align with the L-shaped top surface 221 of the first side piece 220 and the L-shaped top surface 241 of the second side piece 240 respectively.

Figure 7:
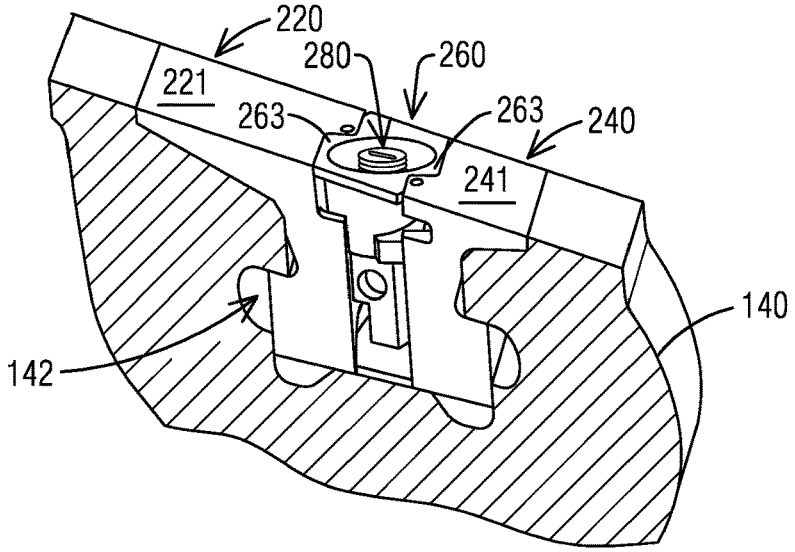

With reference to FIG. 7, the mid piece 260 may then drop down such that the two L-shaped axial side surfaces 263 flush with the L-shaped top surface 221 of the first side piece 220 and the L-shaped top surface 241 of the second side piece 240 respectively. The recess 225 and the circular groove 227 of the first side piece 220 and the recess 245 and the circular groove 247 of the second side piece 240 provide enough clearance for the mid piece 260 to rotate and to drop.

Figure 8:
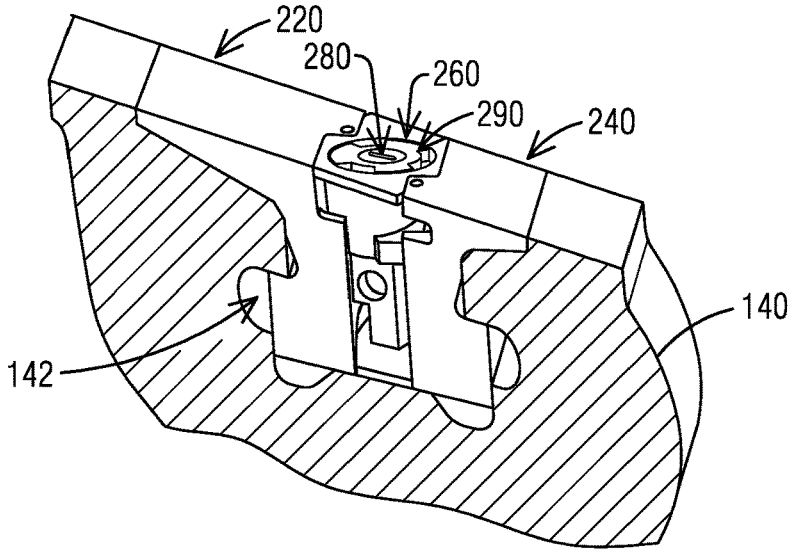
Figure 9:
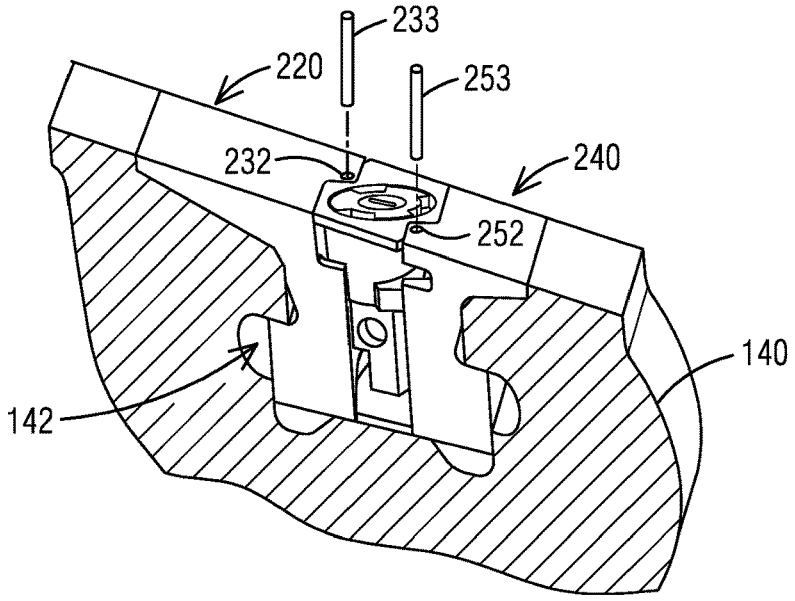

With reference to FIG. 8, the fastener 290 is inserted from top and torqued tightly with the bolt 280. With reference to FIG. 9, the first pin 233 and the second pin 253 may be inserted from top through the aperture 232 of the first side piece 220 and the aperture 252 of the second side piece 240 toward to the middle platform 264 of the mid piece 260 to avoid a radial moment of the mod piece 260.

According to an aspect, the proposed locking spacer assembly 200 includes a first side piece 220 having a recess 225 and a circular groove 227 and a second side piece 240 having a recess 245 and a circular groove 247. The proposed locking spacer assembly 200 includes a mid piece 260 having a hollow cylindrical body 261 and a circular shape 266 of flaps 265. The recess 225 and the circular groove 227 of the first side piece 220 and the recess 245 and the circular groove 247 of the second side piece 240 provide enough clearance for the mid piece 260 to rotate and to drop during assembly which enables an ease of assembly and disassembly.

According to an aspect, the proposed locking spacer assembly 200 includes a first side piece 220 having an aperture 232 and a second side piece 240 having an aperture 252. The proposed locking spacer assembly 200 includes a mid piece 260 having a top platform 262 flushing with top surfaces 221 and 241. The mid piece 260 includes a middle platform 264 disposed radially between the first side piece 220 and the second side piece 240. A first pin 233 and a second pin 253 may be radially inserted through the apertures 232 and 252 toward to the middle platform 264 to avoid a radial movement of the mid piece 260. The proposed locking spacer assembly 200 maintains the mid piece 260 within the assembly without liberating into a flow path in an event of broken or loosen threads between the bolt 280 and the fastener 290. The proposed locking spacer assembly 200 provides a safe design for locking blade spacer.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

REFERENCE LIST

100: Blade Assembly
120: Blade
122: Platform of Blade
124: Root of Blade
140: Rotor Disk
142: Disk Groove
143: Surface of Disk Groove
144: Final Spacer Slot
146: Circumferential Width of Final Spacer Slot
148: Axial Length of Final Spacer Slot
200: Locking Spacer Assembly
206: Circumferential Width of Locking Spacer Assembly
208: Axial Length of Locking Spacer Assembly
220: First Side Piece
221: Top Surface of the First Side Piece

222: Outer Surface of the First Side Piece
223: Inner Surface of the First Side Piece
224: Tab of the First Side Piece
225: Recess of the First Side Piece
226: First Flange Surface of First Side Piece
227: Circular Groove of First Side Piece
228: Second Flange Surface of First Side piece
229: Side Tab of First Side Piece
230: Radial Slot of the First Side Piece
231: Concave Cavity of First Side Piece
232: Aperture of First Side Piece
233: First Pin
240: Second Side Piece
241: Top Surface of the Second Side Piece
242: Outer Surface of the Second Side Piece
243: Inner Surface of the Second Side Piece
244: Tab of the Second Side Piece
245: Recess of the Second Side Piece
246: First Flange Surface of Second Side Piece
247: Circular Groove of Second Side Piece
248: Second Flange Surface of Second Side Piece
249: Side Tab of Second Side Piece
250: Radial Slot of the Second Side Piece
251: Concave Cavity of Second Side Piece
252: Aperture of Second Side Piece
253: Second Pin
260: Mid Piece
261: Hollow Cylindrical Body of Mid Piece
262: Top Platform of Mid Piece
263: Side Surface of Mid Piece
264: Middle Platform of Mid Piece
265: Flap of Mid Piece
266: Upper Portion of Flap
267: Cutout of Flap
280: Bolt
281: Shaft Body of Bolt
282: Threads of Bolt
283: Flat Axial Surface of Bolt
284: Convex Side Surface of Bolt
285: Recess of Bolt
290: Fastener
291: Recess of the Fastener

What is claimed is:

1. A locking spacer assembly configured to fill a final spacer slot in a disk groove between platforms of adjacent blades of a blade assembly comprising:

a first side piece comprising a top surface, an inner surface and an outer surface;

a second side piece comprising a top surface, an inner surface and an outer surface;

a bolt configured to be inserted between the inner surface of the first side piece and the inner surface of the second side piece; and a mid piece configured to be disposed onto the bolt and inserted between the inner surface of the first side piece and the inner surface of the second side piece, wherein the top surface of the first side piece comprises a L-shape formed by a tab and a recess, wherein the top surface of the second side piece comprises a L-shape formed by a tab and a recess, wherein the mid piece comprises a hollow cylindrical body to receive the bolt, wherein the mid piece comprises a top platform disposed around a top of the hollow cylindrical body and a middle platform disposed around a bottom of the hollow cylindrical body, wherein the top platform comprises two L-shaped axial side surfaces adapted to be flush with the L-shaped top surface of the first side piece and the L-shaped top surface of the second side piece, wherein the first side piece comprises an aperture disposed through the tab of the first side piece, wherein the second side piece comprises an aperture disposed through the tab of the second side piece, wherein a first pin and a second pin are radially disposed through the aperture of the first side piece and the aperture of the second side piece extending toward the middle platform of the mid piece, wherein the first side piece comprises a first flange surface extending axially outwardly from the inner surface and located at a radially downward end of the recess, wherein the second side piece comprises a first flange surface extending axially outwardly from the inner surface and located at a radially downward end of the recess, wherein the middle platform of the mid piece rests on the first flange surface of the first side piece and the first flange surface of the second side piece, wherein the first side piece comprises two axial side tabs extending radially upwardly from the first flange surface of the first side piece, and wherein the second side piece comprises two axial side tabs extending radially upwardly from the first flange surface of the first side piece.

2. The locking spacer assembly as claimed in claim 1, wherein the first side piece comprises a circular groove extending radially downwardly from the first flange surface of the first side piece, and wherein the second side piece comprises a circular groove extending radially downwardly from the first flange surface of the second side piece.

3. The locking spacer assembly as claimed in claim 1, wherein the mid piece comprises two flaps extending radially downwardly from the bottom of the hollow cylindrical body to receive the bolt extending through and protruding through the hollow cylindrical body.

4. The locking spacer assembly as claimed in claim 3, wherein the flaps comprise a cutout.

5. The locking spacer assembly as claimed in claim 1, wherein the first side piece comprises a concave cavity disposed at a bottom of the inner surface, wherein the second side piece comprises a concave cavity disposed at a bottom of the inner surface, and wherein the bolt comprises two convex side surfaces disposed at a bottom of the bolt and adapted to be disposed into the concave cavity of the first side piece and the concave cavity of the second side piece.

6. A blade assembly comprising:

a rotor disk comprising a disk groove;

a plurality of blades inserted in the disk groove, wherein each of the blades comprises a platform, and wherein a final spacer slot is formed in the disk groove between platforms of adjacent blades; and a locking spacer assembly configured to fill the final spacer slot, wherein the locking spacer assembly comprises:

a first side piece comprising a top surface, an inner surface and an outer surface;

a second side piece comprising a top surface, an inner surface and an outer surface;

a bolt configured to be inserted between the inner surface of the first side piece and the inner surface of the second side piece; and a mid piece configured to be disposed onto the bolt and inserted between the inner surface of the first side piece and the inner surface of the second side piece, wherein the top surface of the first side piece comprises a L-shape formed by a tab and a recess, wherein the top surface of the second side piece comprises a L-shape formed by a tab and a recess, wherein the mid piece comprises a hollow cylindrical body to receive the bolt, wherein the mid piece comprises a top platform disposed around a top of the hollow cylindrical body and a middle platform disposed around a bottom of the hollow cylindrical body, wherein the top platform comprises two L-shaped axial side surfaces adapted to be flush with the L-shaped top surface of the first side piece and the L-shaped top surface of the second side piece, wherein the first side piece comprises an aperture disposed through the tab of the first side piece, wherein the second side piece comprises an aperture disposed through the tab of the second side piece, wherein a first pin and a second pin are radially disposed through the aperture of the first side piece and the aperture of the second side piece extending toward the middle platform of the mid piece, wherein the first side piece comprises a first flange surface extending axially outwardly from the inner surface and located at a radially downward end of the recess, wherein the second side piece comprises a first flange surface extending axially outwardly from the inner surface and located at a radially downward end of the recess, wherein the middle platform of the mid piece rests on the first flange surface of the first side piece and the first flange surface of the second side piece, wherein the first side piece comprises a circular groove extending radially downwardly from the first flange surface of the first side piece, and wherein the second side piece comprises a circular groove extending radially downwardly from the first flange surface of the second side piece.

7. The blade assembly as claimed in claim 6, wherein the first side piece comprises two axial side tabs extending radially upwardly from the first flange surface of the first side piece, and wherein the second side piece comprises two axial side tabs extending radially upwardly from the first flange surface of the first side piece.

8. The blade assembly as claimed in claim 6, wherein the mid piece comprises two flaps extending radially downwardly from the bottom of the hollow cylindrical body to receive the bolt extending through and protruding through the hollow cylindrical body.

9. The blade assembly as claimed in claim 8, wherein the flaps comprise a cutout.

10. The blade assembly as claimed in claim 6, wherein the first side piece comprises a concave cavity disposed at a bottom of the inner surface, wherein the second side piece comprises a concave cavity disposed at a bottom of the inner surface, and wherein the bolt comprises two convex side surfaces disposed at a bottom of the bolt and adapted to be disposed into the concave cavity of the first side piece and the concave cavity of the second side piece.

11. A method for installing a locking spacer assembly into a final spacer slot in a disk groove between platforms of adjacent blades of a blade assembly, wherein the locking spacer assembly comprises a first side piece, a second side piece, a bolt and a mid piece, the method comprising:

inserting the first side piece and the second side piece into the final spacer slot, wherein the first side piece comprises a top surface, an inner surface and an outer surface, and wherein the second side piece comprises a top surface, an inner surface and an outer surface;

inserting the bolt between the inner surface of the first side piece and the inner surface of the second side piece; and disposing the mid piece onto the bolt and inserted between the inner surface of the first side piece and the inner surface of the second side piece, wherein the top surface of the first side piece comprises a L-shape formed by a tab and a recess, wherein the top surface of the second side piece comprises a L-shape formed by a tab and a recess, wherein the first side piece comprises an aperture disposed through the tab of the first side piece, wherein the second side piece comprises an aperture disposed through the tab of the second side piece, wherein the mid piece comprises a hollow cylindrical body to receive the bolt, wherein the mid piece comprises a top platform disposed around a top of the hollow cylindrical body and a middle platform disposed around a bottom of the hollow cylindrical body, wherein the top platform of the mid piece comprises two L-shaped axial side surfaces, the method further comprising:

rotating the mid piece such that the L-shaped axial side surfaces align with the L-shaped top surface of the first side piece and the L-shaped top surface of the second side piece respectively;

dropping down the mid piece such that the L-shaped axial sides are flush with the L-shaped top surface of the first side piece and the L-shaped top surface of the second side piece, and radially disposing a first pin and a second pin through the aperture of the first side piece and the aperture of the second side piece toward the middle platform of the mid piece.

12. The method as claimed in claim 11, wherein the first side piece comprises a first flange surface extending axially outwardly from the inner surface and located at a radially downward end of the recess, wherein the second side piece comprises a first flange surface extending axially outwardly from the inner surface and located at a radially downward end of the recess, and wherein the middle platform of the mid piece rests on the first flange surface of the first side piece and the first flange surface of the second side piece.

13. The method as claimed in claim 12, wherein the first side piece comprises two axial side tabs extending radially upwardly from the first flange surface of the first side piece, and wherein the second side piece comprises two axial side tabs extending radially upwardly from the first flange surface of the first side piece.

14. The method as claimed in claim 12, wherein the first side piece comprises a circular groove extending radially downwardly from the first flange surface of the first side piece, and wherein the second side piece comprises a circular groove extending radially downwardly from the first flange surface of the second side piece.

15. The method as claimed in claim 14, wherein the mid piece comprises two flaps extending radially downwardly from the bottom of the hollow cylindrical body to receive the bolt extending through and protruding through the hollow cylindrical body.

16. The method as claimed in claim 15, wherein the two flaps of the mid piece slide into the circular groove of the first side piece and the circular groove of the second side piece prior to rotating the mid piece.

* * * * *